United States Patent [19]

Dietz

[11] 4,085,305

[45] Apr. 18, 1978

[54] LIQUID FLOW SWITCH

[76] Inventor: Henry G. Dietz, 80 Salisbury Ave., Garden City, N.Y. 11530

[21] Appl. No.: 748,126

[22] Filed: Dec. 6, 1976

[51] Int. Cl.[2] ..... H01H 35/34

[52] U.S. Cl. ..... 200/83 A; 200/81.9 R

[58] Field of Search ..... 200/81.9 R, 83 R, 83 A, 200/83 J, 83 S, 83 P

[56] References Cited

U.S. PATENT DOCUMENTS

| | | | |
|---|---|---|---|
| 3,256,045 | 6/1966 | Stelzer | 200/81.9 R |
| 3,773,991 | 11/1973 | Krieger | 200/83 S |

*Primary Examiner*—Gerald P. Tolin

[57] ABSTRACT

A liquid flow switch having straight through flow and connections on a common axis. A threaded plug with orifice is interchangable to obtain other rates of specific flow. Flow of fluids through orifice provides a differential pressure to be developed internally of a housing having a pressure responsive diaphragm. The diaphragm supports an actuating element that impinges upon an axially displacable pin extending outwardly of the housing. The pin bears against a flat spring that is flexed to close an electrical contact in dependence upon the specific flow of a liquid.

5 Claims, 4 Drawing Figures

SECTION A-A

SECTION A-A

SECTION B-B

LIQUID FLOW SWITCH

SUMMARY OF THE INVENTION

This invention relates generally to electrical switches and more particularly to an electrical liquid flor switch.

Liquid flow switches are known. Generally these switches are similar in construction to differential pressure switches, except that there is an opening that allows fluid to flow through the switch. The opening acts as an orifice and a differential pressure is developed which is dependent on liquid flow. Generally these switches are difficult to install since the inlet connection often is not on the same axis as the outlet connection. When the two connections are on the same axis, the liquid does not usually flow straight through with the result that there is a large pressure drop when the liquid passes through the flow switch.

Most flow switches are provided with factory set actuating values or with means to vary the range of operation of the switch with regard to flow. This requires that a fixed value of flow be known before installing the switch, or that a means of adjusting the switch in the field requires calibrating equipment to be available.

It is the principal object of the present invention to provide a sensitive electrical liquid flow switch which is inexpensive to construct and is sensitive to specific low rates of liquid flow. It has a minimum of working parts and is able to withstand high internal pressures.

Another object of the present invention is to be able to change factory set actuating values of liquid flow by simple exchange of the threaded plug with an orifice that is calibrated for another specific rate of liquid flow. This eliminates the need for calibrating equipment in the field.

Another object of the present invention is to be able to install the liquid flow switch quickly by having the inlet and outlet connections on a common axis.

Another object of the present invention is to have straight through flow to obtain minimum pressure drop across the switch.

Another object of the present invention is that a single unit is able to handle a large range of liquid flow without incurring large pressure drop across the switch. Manufacturing the switch with connections for the largest anticipated rate of liquid flow, allows the orifice to have extremely small size of orifice for minimum flow and yet be able to handle the maximum rate of flow efficiently.

Another object of the present invention is that a single design is suitable to be constructed of many different materials, for example: plastic, aluminum, and bronze.

And another object of the present invention is that the liquid flow switch can be used to actuate at specific rate of liquid flow higher than the maximum flow rate for which it is designed by simply using a threaded plug that does not have an orifice hole and using the liquid flow switch as a differential pressure switch actuated by the pressure created by an external orifice to which it is connected.

Other features and advantages of the liquid flow switch in accordance with the present invention will be better understood as described in the following specification and appended claims in conjunction with the following drawings in which:

DESCRIPTION OF THE PREFERRED EMBODIMENTS

Figure 1:
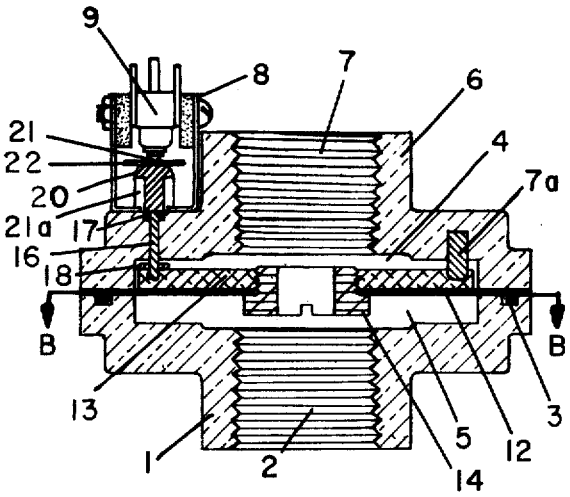
FIG. 1 is a section taken along section line AA of FIG. 3.
Figure 2:
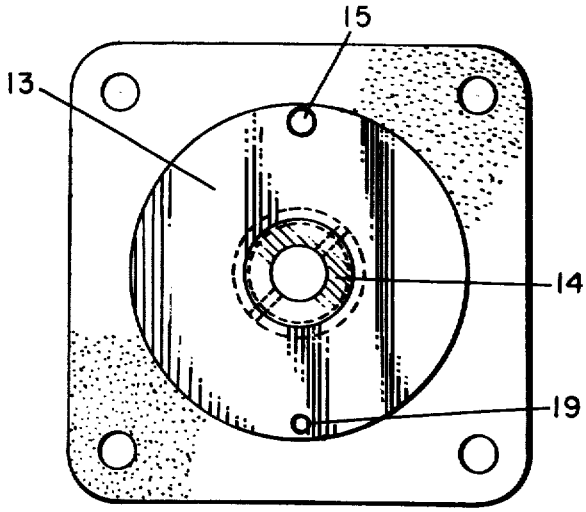
FIG. 2 is a section taken along section line BB of FIG. 1.
Figure 3:
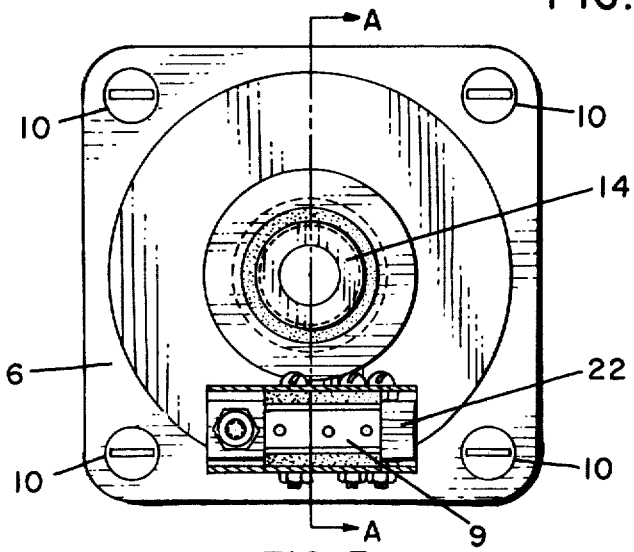
FIG. 3 is a top view of the switch according to the invention.
Figure 4:
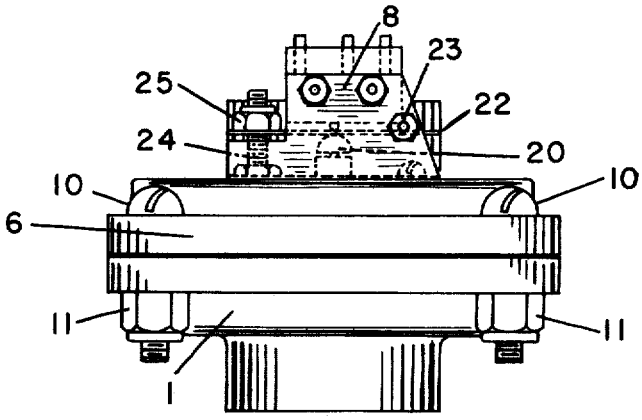
FIG. 4 is a front elevation view of the switch according to the invention.

In accordance with the drawings the liquid flow switch comprises a front housing 1, with an inlet connection 2, and a groove for an "O" ring 3 used to make compartments 4,5 fluid tight. A second housing 6, with an outlet connection 7, has a pin 7A forced into undersize hole in the housing 6, and a surface use for mounting a bracket 8 used for holding an electrical switch 9. The housings 1, 6 are held together by a plurality of screws 10 and nuts 11. Between the housings 1, 6 is mounted a diaphragm 12 made of a flexible material; for example cloth suitably impregnated with butyl or silicone, and a diaphragm pressure plate 13 which comprises a circular disc 13 and a threaded plug 14 with orifice. The circular disc 13 has a hole 15 drilled to a depth equal to one half the thickness of the disc 13 and fits loosely over the pin *7a*. The pressure plate 13 pivots about the pin *7a*.

A floating pin 16, is axially movable in the housing 6, and passes through an "O" ring 17, used to make the compartment 4 fluid tight with respect to the pin 16. The pin 16 fits loosely into a hole 19 on disc 13. The hole 19 is drilled to a depth equal to one half the thickness of the disc 13. The pin 16 is within a loosely fitting bushing 18, which is used as a stop. The pin 16 actuates a floating pin 20 provided with a head larger than the shank of the pin 20, is axially movable in a bearing 21*a* mounted on the bracket 8. The pin 20 is moved axially in response to the flexing of the diaphragm 12 and the diaphragm pressure plate 13 as later described.

The bracket 8 is mounted on the housing 6 and supports thereon the micro switch 9 having an electrical contact 21 bearing against a flexible flat clock spring 22 pivoting about a screw 23 fastened with a nut 23 to the bracket 8. A stud 24 is fastened to the bracket 8 and passes through the flexible flat clock spring 22. An adjustment nut 25 tensions the flexible flat clock spring 22 and varies the pressure required to actuate the microswitch 9.

In operation a liquid flows into the inlet connection 2, and through the orifice plug 14. The size of the opening in the orifice plug 14 determines the amount of differential pressure obtained by a specific rate of liquid flow as it passes through the liquid flow switch and out the outlet connection 7.

The differential pressure acts on the diaphragm 12, actuating the diaphragm pressure plate 13 to pivot about the pin *7a* and actuate the floating pin 16, which actuates the floating pin 20 which bears on the flat clock spring 22 which will flex and actuate the micro switch contact.

A sensitivity of 0.05 gallons per minute has been obtained in a switch that could be factory set to actuate up to 10 gallons per minute.

Increasing the size of the liquid flow switch to obtain higher maximum rates of liquid flow also increases the sensitivity of the liquid flow switch to the lowest flow rate.

Maximum pressure that the liquid flow switch can operate at is dependent upon the maximum pressure rating of the "O" ring seals 3, 17 used, the micro switch 9 actuating force, and the diameter of the pin 16. Increasing the micro switch 9 actuating force and decreasing the diameter of the pin 16 increases the maximum pressure rating of the liquid flow switch.

The threaded plug 14 is provided with a screw driver slot on the side facing the housing 1, this allows the threaded plug 14 to be removed through the inlet connection 2 by unscrewing from the disc 13. The unscrewed threaded plug 14 can be replaced with other pre-calibrated orifice plugs having openings calibrated for other rates of flow.

This also makes possible the stocking of a single unit in inventory to cover various ranges of flow by simple changing of the size of the opening in the orifice by drilling to a larger size.

Field changes requiring flow rate changes can be made by simply interchanging pre-calibrated orifice plugs and does away with the need for the requirement of calibrating test equipment in the field.

Modifying the liquid flow switch, by using an orifice plug without an opening, makes the liquid flow switch into a differential pressure switch that can be actuated by differential pressure, pressure, or vacuum. This differential pressure switch can be connected to a large pipe having an internal orifice and be actuated by the pressure drop across the orifice in the large pipe. When so used, there is no limit to the maximum flow that the differential pressure switch can be actuated by.

What I claim and desire to secure by letters patent is:

1. A liquid flow switch comprising two housings, defining a fluid tight space there between, a flexible pressure responsive diaphragm comprising a flexible material, a diaphragm plate, wherein said diaphragm and said diaphragm plate are secured together by means of a threaded plug, said threaded plug having an opening providing communication between two compartments, whereby the size of said opening functions to determine a differential pressure for a specific flow rate obtained through said opening, said flexible pressure responsive diaphragm separates the space into two said compartments, a rigid member of one said compartment having an edge surface in said space opposed to an edge surface of second compartment and in close proximity therewith, the edge surfaces jointly defining a clamp to hold said pressure responsive diaphragm, a pin extending from said housing provides means for pivoting said pressure diaphragm plate about said pin, an electrical contact mounted on said housing exteriorly of said space, an actuator for actuating said contact to an operative position comprising a flexible flat spring mounted exteriorly of said housing for flexing to a position to close said contact, an axially displacable pin in communication with the interior of said housing, and extending outwardly thereof for bearing against said flexible flat spring to deflect in a direction for closing said contact, an activating element mounted on said diaphragm for movement therewith to contact and engage said pin to actuate it in response to a pressure differential in said compartments flexing the diaphragm in a direction for actuating said liquid flow switch, and connectors for applying the fluid to two said compartments to develop said differential pressure whereby said differential pressure is a function of size of opening in said threaded plug for a specific flow rate.

2. A liquid flow switch according to claim 1, in which said diaphragm comprises a circular flexible area, said diaphragm pressure plate having said circular area of lesser dimension to the area of said flexible material, and means for fluid to flow directly through center of said pressure responsive diaphragm.

3. A liquid flow switch according to claim 1, in which said actuating element is disposed adjacent said diaphragm pressure plate edge surface, providing means for said electrical contact to be disposed from center of said liquid flow switch, having means for connections of said liquid flow switch to be in same axis.

4. A liquid flow switch according to claim 1, in which said threaded plug is removable from said pressure responsive diaphragm, thereby providing means for interchanging said threaded plugs with threaded plugs having different size openings.

5. A differential pressure switch comprising two housings, defining a fluid tight space there between, a flexible pressure responsive diaphragm comprising a flexible material, a diaphragm plate, wherein said diaphragm and said diaphragm plate are secured together by means of a threaded plug, said threaded plug is solid, whereby said flexible pressure responsive diaphragm separates space into two said compartments, a rigid member of one said compartment having an edge surface in said space opposed to an edge surface of second compartment and in close proximity therewith, the edge surfaces jointly defining a clamp to hold said pressure responsive diaphragm, a pin extending from said housing provides means for pivoting said pressure diaphragm plate about said pin, an electrical contact mounted on said housing exteriorly of said space, an actuator for actuating said contact to an operative position comprising a flexible flat spring mounted exteriorly of said housing for flexing to a position to close said contact, an axially displacable pin in communication with the interior of said housing, and extending outwardly thereof for bearing against said flexible flat spring to deflect in a direction for closing said contact, and activating element mounted on said diaphragm for movement therewith to contact and engage said pin to actuate it in response to a pressure differential in said compartments flexing the diaphragm in a direction for actuating said differential pressure switch, and connections for applying the pressure to the two said compartments to develop said differential pressure whereby said differential pressure switch is actuable when a specific differential pressure is obtained through said connections.

* * * * *